United States Patent [19]

Suzuki et al.

[11] 4,050,342

[45] Sept. 27, 1977

[54] MUSIC BOX TOY

[75] Inventors: Ikuo Suzuki, Urawa; Shuji Nishiyama, Okaya, both of Japan

[73] Assignee: Kabushiki Kaisha Sankyo Seiki Seisakusho, Japan

[21] Appl. No.: 702,023

[22] Filed: July 2, 1976

[30] Foreign Application Priority Data

July 5, 1975 Japan ..... 50-93363[U]

[51] Int. Cl.[2] ..... G10K 1/06

[52] U.S. Cl. ..... 84/95 C; 84/94 C

[58] Field of Search ..... 46/59, 180, 189; 84/94, 84/96

[56] References Cited

U.S. PATENT DOCUMENTS

| | | | |
|---|---|---|---|
| 3,529,378 | 9/1970 | Kinberg | 46/175 |
| 3,535,819 | 10/1970 | Spilhaus | 46/175 |

*Primary Examiner*—Russell R. Kinsey
*Assistant Examiner*—Robert F. Cutting
*Attorney, Agent, or Firm*—Cooper, Dunham, Clark, Griffin & Moran

[57] ABSTRACT

A music box toy comprises a music box contained within the toy, a movable appendage partially projecting externally of the toy, means for driving the appendage, and a connecting member for operationally connecting the appendage with the drive means. During playing time of the music box, the appendage is moved by the drive means. On the other hand, when the appendage is externally moved, the connecting member is adapted to move away from the drive means.

9 Claims, 8 Drawing Figures

MUSIC BOX TOY

BACKGROUND OF THE INVENTION

The invention relates to a toy internally housing a music box, and more particularly, to an animated music box toy having a movable appendage which is moved during the playing time of the music box.

A music box toy of the type having a movable appendage which is adapted to be moved during the playing of the internally housed music box is generally well known. A music box toy of this kind includes a connecting member which is disposed between the operationally connects the appendage and a drive to which a rotating motion is imparted from a rotating body located within the music box so that the operation of the drive is transmitted to the appendage through the connecting member.

The movable appendage may take a variety of forms. For example, if the toy is shaped as a bird, the appendage will be formed as a pair of wings. If the toy is in the form of a child, the appendage will be implemented as a pair of arms. Usually, the movable appendage is adapted to reciprocate in the vertical direction or back and forth.

The movable appendage is inherently designed to move under the control of a drive contained within the toy. However, because the appendage projects externally of the toy, children playing with the toy tend to grasp the appendage with their hands or to move the appendage about out of curiosity. A conventional music box toy is constructed such that when the appendage is externally moved, such movement is transmitted to the drive means through a connecting member, or the movement of the connecting member is constrained by the drive means, so that if the appendage is externally moved in a forcible manner, the appendage, drive means or connecting member or their accessories may be damaged.

SUMMARY OF THE INVENTION

It is an object of the invention to provide an improved music box toy which eliminates the above disadvantage of conventional music box toys.

It is another object of the invention to provide a music box toy which assures a positive connection between a drive source contained within a music box and the drive means for the appendage but which is also disconnectable.

Other objects of the invention will become apparent from the following description of several embodiments thereof shown in the drawings.

It is a major feature of the invention that the connecting member is supported in a freely movable manner so as to be disengaged from the driven part of the appendage, in order to avoid undue forces being applied to any of the driven part appendage, the connection between the driven part and the appendage and other parts thereof, when the movable appendage of the music box toy is moved by an external force. As a consequence, no interference is caused to the music box toy when the movable appendage, which is designed for movement under the control of the internally housed drive means, is moved by an external force such as by being swung about by a hand of a child.

DETAILED DESCRIPTION OF PREFERRED EMBODIMENTS

Figure 1:
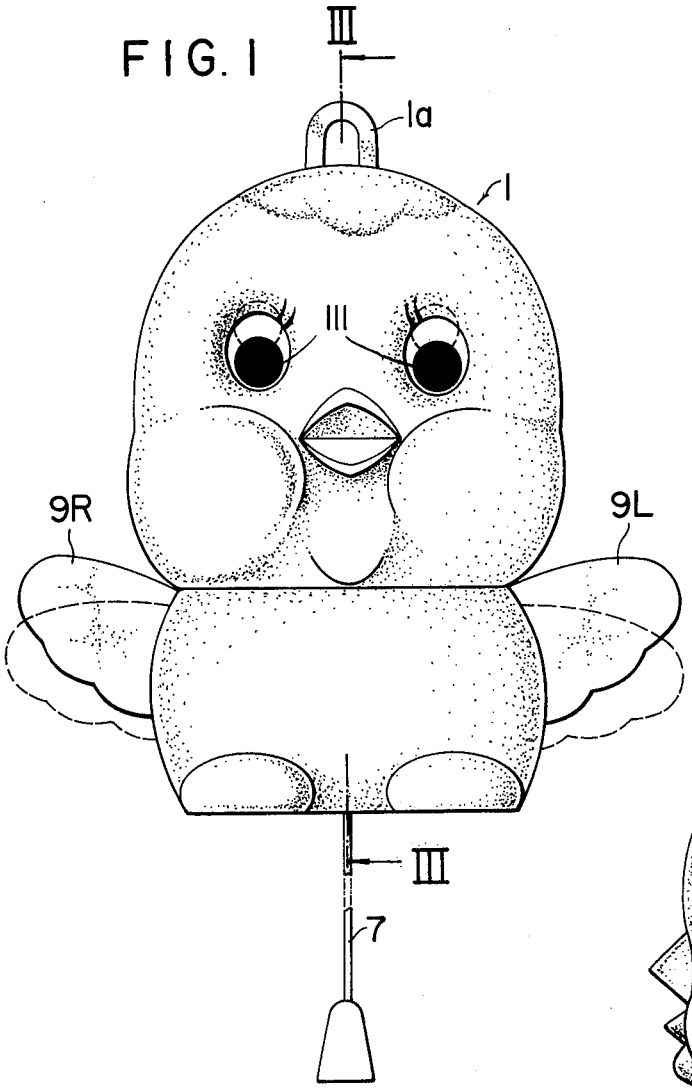
FIG. 1 is a front view of a music box toy constructed in accordance with one embodiment of the invention.
Figure 2:
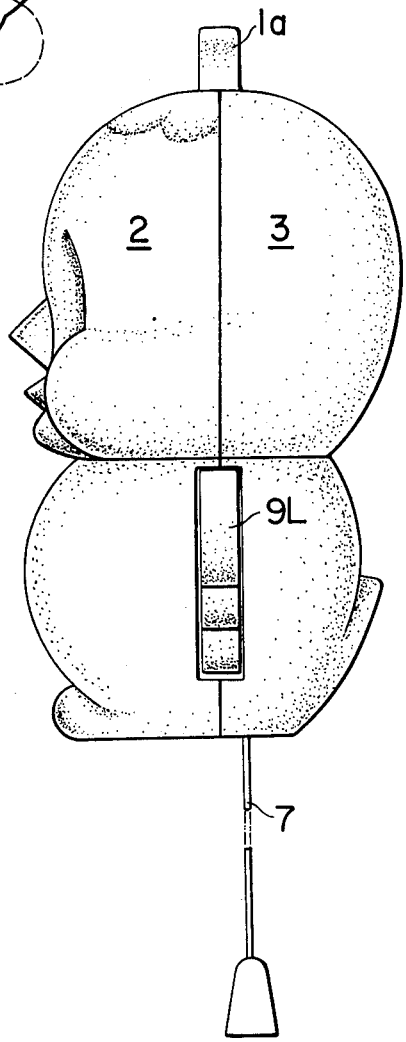
FIG. 2 is a right-hand side elevation of the toy of FIG. 1.
Figure 5:
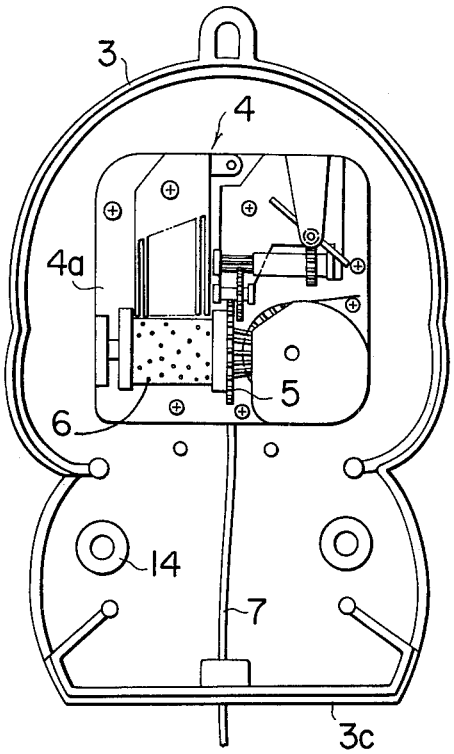
FIG. 5 is a front view of the rear half of the toy of FIG. 1.

Referring to the drawings, a music box toy 1 is shown in FIG. 1 adapted to be suspended on a wall by an eyelet 1*a* or placed on a table. The body of the toy 1 comprises a pair of housings in the form of a front half and a rear half 2 and 3, respectively, (FIG. 2) which are adhesively joined together to form an inner hollow space. The rear half 3 is integrally formed with a pair of horizontally extending posts 3*a*, 3*b* (FIG. 3) on which a music box 4 of a conventional construction is secured as by fixing its substrate 4*a* by set screws. Since the internal construction of the music box has no connection with the present invention, it will not be described in detail herein, and it is sufficient for the present purpose to mention that it includes a drum-shaped gear 5 which is secured to one end of a well-known rotating drum 6 (FIG. 5) fixedly carrying a number of pins around its periphery.

The music box 4 is adapted to be driven by the resilience of a spring which is tensioned when a string 7 extending downwardly from the music box 4 through a bottom plate 3*c* (FIG. 5) of the rear half 3 is pulled. A music box toy which is constructed to be charged by an external string and to initiate the playing of the music box at the time the string is released is well known.

The front half 2 of the body includes a pair of laterally extending movable appendages 9L and 9R disposed in its lower portion, and also includes a drive unit 10 (FIG. 3) in its central region, which unit is adapted to be driven by the drum gear 5. The appendages 9L, 9R and the drive unit 10 are operationally connected together through a connecting member 11 which is disposed therebetween. The movable appendage 9R is rockably mounted by having a mounting hole therein (not shown) fitted on a stem 12*a* of a reduced diameter at the rear end of a post 12 which is integrally formed with the front half 2. The disengagement of the appendage 9R from the stem 12*a* is prevented by another post 14 formed on the rear half 3 which has its end face brought into abutting engagement against the end face of the stem 12*a* when the both halves 2, 3 and joined together. The bonding between the both halves 2, 3 can be further enhanced by clamping the both posts 12, 14 together by a threaded bolt 15 which is inserted from the rear of the rear half 3 after both halves have been adhesively joined together.

Figure 4:
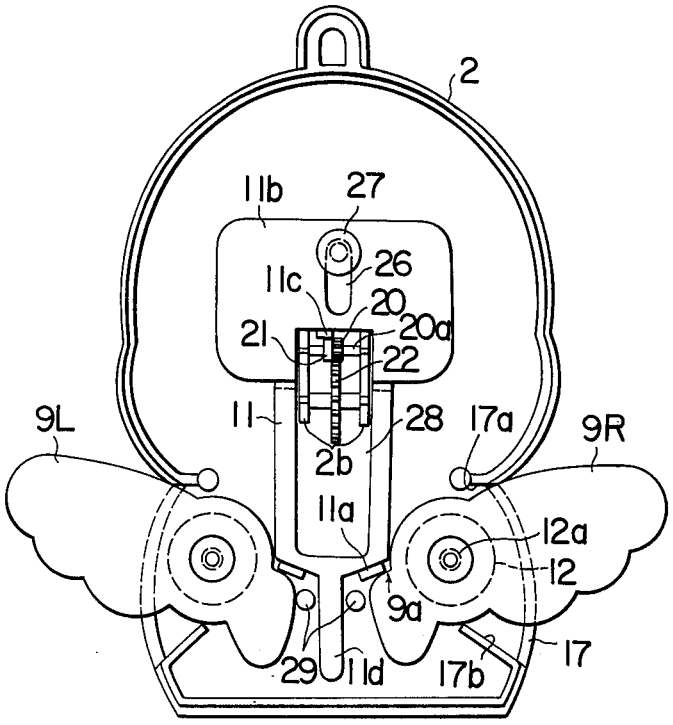
FIG. 4 is a rear view of the front half of the toy of FIG. 1.

Referring to FIG. 4, it will be noted that the appendage 9R is urged, by gravity, to rotate clockwise about the stem 12*a*, but the resulting rotation is blocked by the abutment of a shoulder 9*a* formed on the inner end of the appendage 9R against a jaw or bend 11*a* formed in the connecting member 11. The extent of rocking motion of the appendage 9R is limited by an upper end a lower edge 17*a*, 17*b* of a notch 17 formed in the front and rear halves 2 and 3.

Figure 6:
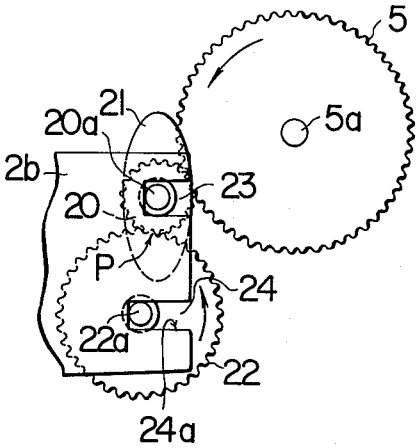
FIG. 6 is an enlarged side elevation of a support mechanism for the driven part of an appendage which is operatively connected with a drum-shaped gear of a music box.

The other appendage 9L is configured and arranged symmetrically to the appendage 9R with respect to a vertical centerline of the front half 2, as viewed in FIG. 4. The drive unit 10 for the appendages, shown enlarged in FIG. 6, comprises a gear 20 which meshes with the drive gear 5, a cam 21 which is substantially integral with the gear 20, another gear 22 meshing with the gear 20, and a member 2*b* which supports the shafts 20*a*, 22*a* of the gears 20, 22. The support means 2*b* comprises a pair of plates integrally formed with the front half 2 and disposed in opposing relationship, and these plates are formed with a pair of vertically spaced rectangular notches 23, 24 into which the opposite ends of the shafts 20*a*, 22*a* are loosely fitted so as to be rotatable therein.

Figure 3:
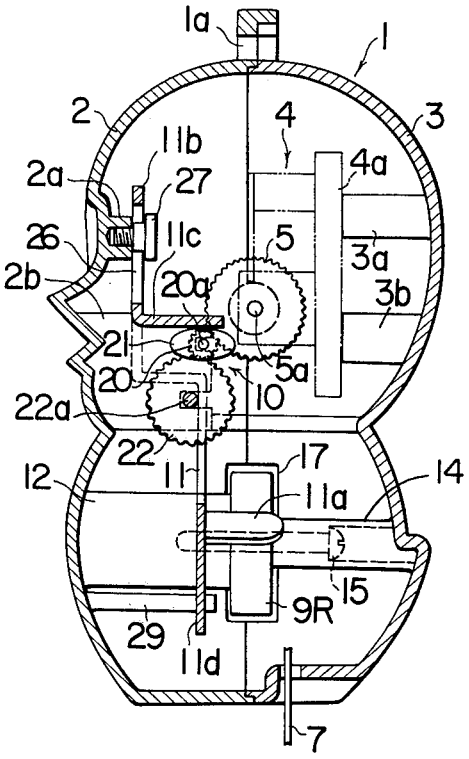
FIG. 3 is an elevational section taken along the line III—III in FIG. 1.

Referring to FIGS. 3 and 4, it will be noted that the three gears 5, 20 and 22 are located relative to each other such that the shaft 20*a* of the gear 20 is situated forwardly of a line joining the shaft 5*a* of the drive gear 5 and the shaft 22*a* of the gear 22, and when the gear 5 rotates in the counterclockwise direction, the gears 20, 22 are urged in a direction such that their shafts 20*a*, 22*a* are driven toward the inner end of the notches 23, 24, thereby preventing a rattling of these gears while they are driven by the gear 5. The notches 23 in which to receive the shaft of the gear 20 have a width which is slightly greater than the diameter of the shaft 20*a* so as to facilitate a meshing engagement with the gears 5 and 22.

When not being driven by the gear 5 or when the music box is not in operation, the disengagement of the gear 22 from the notches 24 is prevented by locating the shaft 22*a* more inward into the notches 24 than a perpendicular drawn from the point of contact P between the gears 20 and 22 to one side 24*a* of the notches 24.

Figure 7:
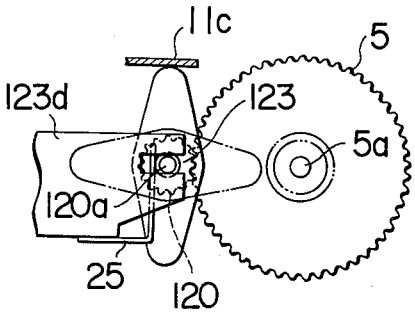
FIG. 7 is a side elevation of another example of a support mechanism as in FIG. 6.

In this manner, the gear 22 serves to assure a positive engagement of the gear 20 provided on the part of the front half 2 with the gear 5 provided on the part of the rear half 3. However, the positive engagement of the gear 20 with the gear 5 can also be assured, instead of using the gear 22, by resiliently urging the shaft 20*a* of the gear 20 toward the gear 5, as illustrated in FIG. 7. Referring to this Figure, a gear 120 which meshes with the gear 5 has its shaft 120*a* fitted into recesses 123 formed in support plates 103*d*, and is urged toward the gear 5 by a leaf spring 25 which is secured to the support plates 103*d*. The shaft 120*a* of the gear 120 is received in the notches 123 before the front and rear halves 2, 3 are joined together, and leaf spring 25 has a configuration in its untensioned condition not to urge the shaft 120*a* out of the notches 123. When the front and rear halves are joined together, the gear 5 is brought into engagement with the gear 120 against the resilience of the spring 25. The gear 120 fixedly carries a cam 121 which serves to drive the appendages.

Referring to FIGS. 3 and 4, the connecting member 11 includes a vertically extending lower portion 11*a*, a vertically extending upper portion 11*b*, and a horizontally extending portion which connects the vertical portions 11*d* and 11*b* together. The upper portion 11*b* is formed with a vertical elongate slot 26, which is engaged by a headed pin 27 which is fixedly mounted on an internal projection 2*a* integrally formed with the front half 2, thereby supporting the connecting member so as to be slidable in the vertical direction. The connecting member 11 also includes a horizontal arm 11*c* which extends rearwardly from the upper portion 11*b*, the horizontal arm 11*c* bearing against the cam 21 from above. At this end, the connecting member 11 may have sufficient weight to overcome the tendency of the appendages 9R, 9L to rotate in a direction to push up the connecting member. Alternatively, the connecting member 11 may be resiliently biased in the downward direction. An opening 28 is formed in the connecting member 11 to avoid an interference with the drive unit 10, and a tail on lower portion 11*d* extends from the bottom of the frame which forms the opening 28 for fitting engagement between a pair of thin rods 29 which are integrally formed with the front half 2.

When the gear 20 is driven by the gear 5, the cam 21 which is integral therewith rotates to raise the arm 11*c* against the downward bias of the connecting member 11 and the tendency of rotation of the appendages 9R, 9L, and then as the cam 21 further rotates, the connecting member 11 becomes free to move down, whereby the appendages 9R, 9L repeat an oscillating motion in the vertical direction during the playing of the music box.

When the music box is in its playing mode or in its inoperative condition, an external force applied to the appendage 9R to rock it may result in the shoulder 9*a* acting to raise the connecting member 11. However, the arm 11*c* of the connecting member 11 moves away from the cam 21 at this time, so that the transmission of the force from the appendage 9R to the drive unit 10 is avoided. The same applies to an external force applied to the other appendage 9L.

Figure 8:
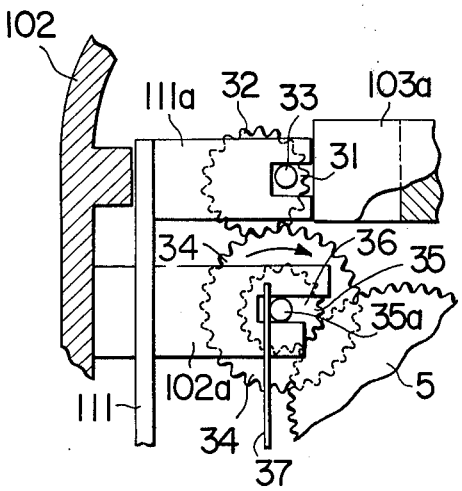
FIG. 8 is a fragmentary side elevation of another embodiment of the invention.

Instead of using the cam 21, a vertical oscillation of the connecting member 11 can also be achieved by providing a gear, with an eccentric pin which is rotatably mounted on the connecting member, and driving this gear. FIG. 8 shows such an alternative arrangement for the drive unit in which the upper end of the connecting member 111 is formed with a rearwardly extending arm 111*a*, the end of which is provided with the notch 31 for loose fitting engagement with an eccentric pin 33 fixedly mounted on a gear 32 which is in turn disposed in meshing engagement with a gear 34. The gear 34 is fixedly mounted on another gear 35 which meshes with the drum gear 5 provided on the rear half. The gear 35 has its shafts 35*a* fitted into the notches 36 in a support 102*a* which is integral with front half 102, whereby the shaft 35*a* is rotatably mounted. The shaft 35*a* is urged toward the gear 5 by a leaf spring 37.

When the gear 34 is driven clockwise by the gear 5 the gear 32 rotates counter-clockwise with rocking motion thereon to cause the eccentric pin 33 to move the connecting member 111 up and down. The gear 32 merely bears against the gear 34 from above, so that the connecting member 111 is free to move upwardly while carried by pin 33. The disengagement of the pin 33 from the notches 31 in the rearward direction is prevented by having the end face of a forward projection 103*a* from the rear half disposed in opposing relationship with the end of the pin 33 while gear 32 is permitted to move in and out of a slot therein.

Although not shown in FIGS. 3 and 4, a pair of colored eyeballs 111 may be provided on the upper portion 11*b* of the connecting member 11 behind the eyesockets as depicted in FIG. 1 so that they move up and down as the appendages rock.

What is claimed is:

1. In a music box toy of the type including a movable appendage which projects externally of the body of the toy and which is adapted to be moved by a drive source contained within the music box during the playing thereof, the improvement comprising a drive unit for the appendage, and means for connecting the drive unit and the appendage, said connecting means being disengageable from the drive unit when the appendage is moved by an external force.

2. A music box toy according to claim 1 in which the drive unit is driven by the drive source within the music box.

3. A music box toy according to claim 1 in which the drive unit includes a cam which is driven by the drive source within the music box, and said connecting means comprises means for bearing against the cam from above.

4. A music box toy according to claim 1 in which said connecting means comprises an arm and the drive unit includes a first gear which is driven by the drive source within the music box, and further comprising a second gear carrying an eccentric pin and bearing against said first gear of the drive unit from above, the eccentric pin being loosely carried by said arm of the connecting means.

5. A music box toy according to claim 1 in which the body of the toy comprises a front half and a rear half which are joined together, the music box being contained in the rear half, and the appendage, the drive unit and the connecting means being mounted in the front half.

6. A music box toy according to claim 1 in which the movable appendage comprises a pair of rocking members partially projecting externally of the body from the opposite lateral sides thereof in a symmetrical manner with respect to the centerline of the body.

7. A music box toy according to claim 4 in which the music box includes a third gear for driving the drive unit, and further comprising means for resiliently urging the first gear of the drive unit into engagement with the third gear.

8. A music box toy according to claim 4 in which the body comprises support members and the music box includes a drive gear for driving the drive unit, and in which the drive unit includes a cam gear engageable with the drive gear and integrally carrying a cam which is operative to drive the connecting means, and an idling gear meshing with the cam gear, said cam gear and said idling gear having their shafts loosely fitted in notches formed in the support members, said cam gear being disposed forwardly of a line joining the axes of the shaft of the drive gear and the shaft of the idling gear.

9. A music box toy according to claim 1 further comprising a cam and in which the drive unit includes a gear which fixedly carries said cam for driving the connecting means.

* * * * *